US005713982A

United States Patent [19]

Clark et al.

[11] Patent Number: 5,713,982

[45] Date of Patent: Feb. 3, 1998

[54] IRON POWDER AND METHOD OF PRODUCING SUCH

[76] Inventors: Donald W. Clark, P.O. Box 27566, 1600 Wahoo La., Bay Point, Panama City, Fla. 32411; C. William Cornelssen, 127 Birch Bend Dr., Alpharetta, Ga. 30201

[21] Appl. No.: 571,413

[22] Filed: Dec. 13, 1995

[51] Int. Cl.[6] ..... B22F 9/22

[52] U.S. Cl. ..... 75/359; 75/360; 75/369

[58] Field of Search ..... 75/359, 360, 369

[56] References Cited

U.S. PATENT DOCUMENTS

| | | | |
|---|---|---|---|
| 2,445,648 | 7/1948 | Truesdale | 75/359 |
| 3,419,383 | 12/1968 | Hatcher et al. | 75/359 |
| 4,054,443 | 10/1977 | Jaco | 75/359 |
| 4,300,948 | 11/1981 | Metz | 75/34 |
| 4,330,325 | 5/1982 | Keran et al. | 75/36 |
| 4,430,116 | 2/1984 | Yamazaki et al. | 75/34 |
| 5,234,489 | 8/1993 | Streicher et al. | 75/351 |
| 5,376,162 | 12/1994 | Cavanagh | 75/749 |
| 5,395,463 | 3/1995 | Johnen et al. | 148/513 |
| 5,405,572 | 4/1995 | DeVolk | 419/9 |
| 5,531,922 | 7/1996 | Okinaka et al. | 75/255 |

FOREIGN PATENT DOCUMENTS

| | | | |
|---|---|---|---|
| 47-18206 | 5/1972 | Japan | 75/359 |
| 1127145 | 9/1968 | United Kingdom | 75/369 |

OTHER PUBLICATIONS

*ASM Handbook*, vol. 7, Powder Metallurgy, pp. 79–83, 176–177, and 214–216, ASM, 1984.

*Primary Examiner*—George Wyszomierski
*Attorney, Agent, or Firm*—Kennedy, Davis & Kennedy

[57] ABSTRACT

A method of producing iron powder comprises the step of providing a supply of iron oxide powder of a size less than 1000 microns which is then heated in a reducing agent atmosphere to a temperature between 1000° F. and 2100° F., thus resulting in the iron oxide powder being reduced to iron powder, cooling the iron powder in an inert gas atmosphere to a temperature below 150° F. and milling to a median particle size diameter of less than or equal to 20 microns.

44 Claims, 7 Drawing Sheets

MEAN: 20.10 μm

MEDIAN: 8.994 μm

MEAN: 1.126 (μm)

MEDIAN: 0.738 (μm)

MEAN 275.0 μm

MEDIAN 152.2 μm

MEAN 5.476 μm

MEDIAN 5.291 μm

| Particle shape | Particle Size Distribution (microns) | Tap Density (%TD) | Solids Loading (%) |
|---|---|---|---|
| rounded | $D_{10}$:1.8 $D_{50}$:2.7 $D_{90}$:3.9 (Horiba) | 35 | 60 |

Inventive Iron Powder characteristics

FIG 7

| Attributes | Ideal | Measured |
|---|---|---|
| Particle Shape | spherical | rounded |
| Particle Size | < 20 microns | 2.7 microns |
| Distribution Width | <2 or >7 | 7.57 |
| True Density | 100% | 98% |
| Torque (mg) | 100-200 | 80 @59% |

Comparison of ideal iron density versus inventive iron powder measured attributes

FIG 8

| Powder type | Green Density (%TD) | Sintered Density (%TD) | Tensile Strength (MPa) | Ductility (%) |
|---|---|---|---|---|
| CIP | 67 | 87 | 211 | 17 |
| IIP | 61 | 93 | 290 | 14 |

Sintered Properties of carbonyl iron powder (CIP) and inventive iron powder (IIP)

FIG 9

IRON POWDER AND METHOD OF PRODUCING SUCH

TECHNICAL FIELD

This invention relates to iron powders and methods of producing iron powders, and specifically to methods of producing iron powder from iron oxide powder.

BACKGROUND OF THE INVENTION

For many centuries iron products have been made by heating iron oxide in the presence of carbon, thereby reducing the iron oxide to pure iron in a molten state along with a quantity of waste slag. The molten iron is separated from the waste slag and either cast into billets or poured into product molds. In order for this process route to be used commercially large and very expensive equipment must be used. Recently however iron products have been manufactured by two methods commonly referred to as powder metallurgy (PM) and metal injection molding (MIM).

In powder metallurgy, iron powder in combination with a small amount of binder is positioned within a mold and compressed by a hydraulic press to form a blank which is then sintered to form the finished product. Products produced by powder metallurgy are of relatively simple configuration as the molds used to produce the blanks are limited in their ability to produce complicated shapes.

In metal injection molding, an extremely pure and extremely fine iron powder in combination with a binder, such as wax-polypropylene, is injected into a product mold under pressure to compress the combination within the mold to form a blank. The blank is then removed from the mold and heated causing the binder to melt out and the remaining iron powder to bind together to form the finished product, i.e. the blank is sintered. This method of producing finished goods has been proven to be safer, more economical and easier in producing small and intricate finished goods than methods of production using molten iron. However, this method must use iron powder of a smaller and more consistent spherical configuration than with powder metallurgy.

Iron powder used in the just described metal injection molding (MIM) method typically has a median particle size diameter of less than 20 microns. In the past iron powder for MIM use has been produced by two methods. One such method of production has been by a chemical process wherein extremely small iron oxide spheres are produced by chemical vapor decomposition. This method produces an iron powder product commonly referred to as carbonyl iron powder. The capitol and operating cost associated with this method results in the finished iron powder being economically limited.

Accordingly, it is seen that a need remains for a method of producing iron powder in a more economic manner. It is to the provision of such therefore that the present invention is primarily directed.

SUMMARY OF THE INVENTION

In a preferred form of the invention a method of producing iron powder used in metal injection molding comprises the steps of heating a supply of iron oxide powder having a median particle size of less than 1000 microns in a reducing agent atmosphere to a temperature between 1000° F. and 2100° F., thereby reducing the iron oxide powder to iron powder. The iron powder is then cooled in an inert gas atmosphere to a temperature below 150° F. and milled in an inert gas atmosphere to a median particle size diameter of less than or equal to 20 microns.

BRIEF DESCRIPTION OF THE DRAWING

FIG. 7 is a table of characteristics of the iron powder of FIG. 6.

FIG. 8 is a table of characteristics of the iron powder of FIG. 6 and ideal iron powder.

FIG. 9 is a table of sintered properties of products produced with the iron powder of FIG. 6 and carbonyl iron powder.

DETAILED DESCRIPTION

Figure 1:
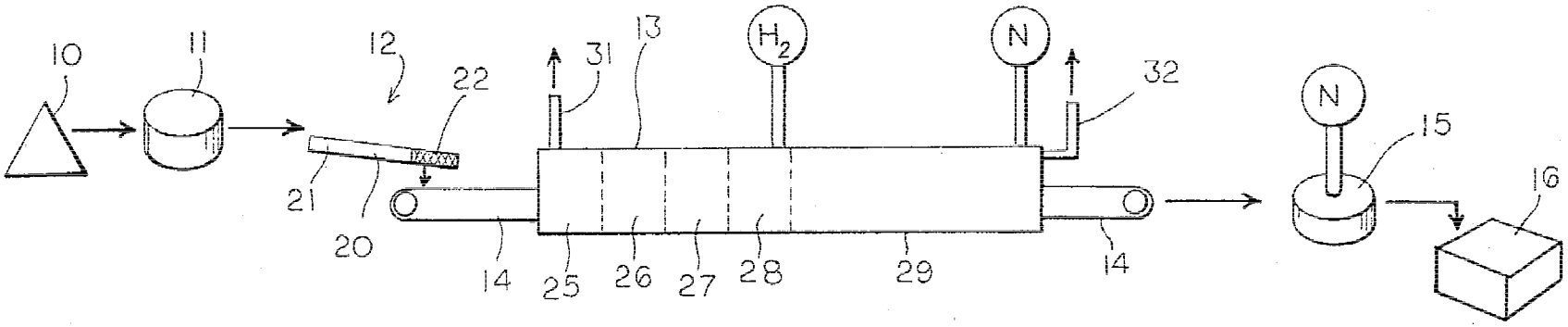
FIG. 1 is a schematic view of equipment used in performing the method of the present invention.
Figure 2:
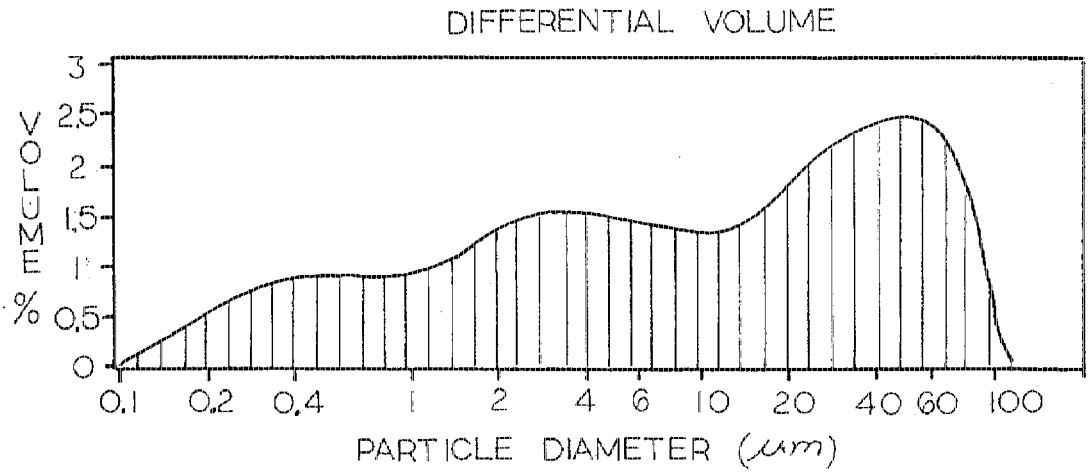
FIG. 2 is a graph illustrating the size distribution of iron oxide powder feed, volume percentage versus particle diameter, used in performing the method of the present invention showing.

The production of iron powder in its preferred form is illustrated with reference to the schematic diagram of FIG. 1. There is shown a feed supply of iron oxide powder 10, a first grinding or milling system 11, a feeding and screening system 12, a muffle furnace 13 having a stainless steel conveyor belt 14, a second grinding or milling system 15 and a packaging container 16. The iron oxide powder is preferably Hematite ($Fe_2O_3$) such as that commonly known in the trade as Ruthner iron oxide, which typically has a median particle size diameter of approximately 20 microns as shown in FIG. 2. The first and second grinding systems 11 and 15 are preferably a jet mill such as the Micron-Master jet mill produced by The Jet Pulverizer Company, Inc. of Moorestown, N.J. The screening system 12 includes vibrating bed 20 having a first, solid portion 21 and a second, mesh portion 22.

The muffle furnace has a first preheating zone 25, a second preheating zone 26, a first hot zone 27, a second hot zone 28 and a cooling zone 29 through which the conveyor belt passes. Each of the preheating zones and hot zones are approximately five feet long while the cooling zone is approximately twenty feet long.

Figure 3:
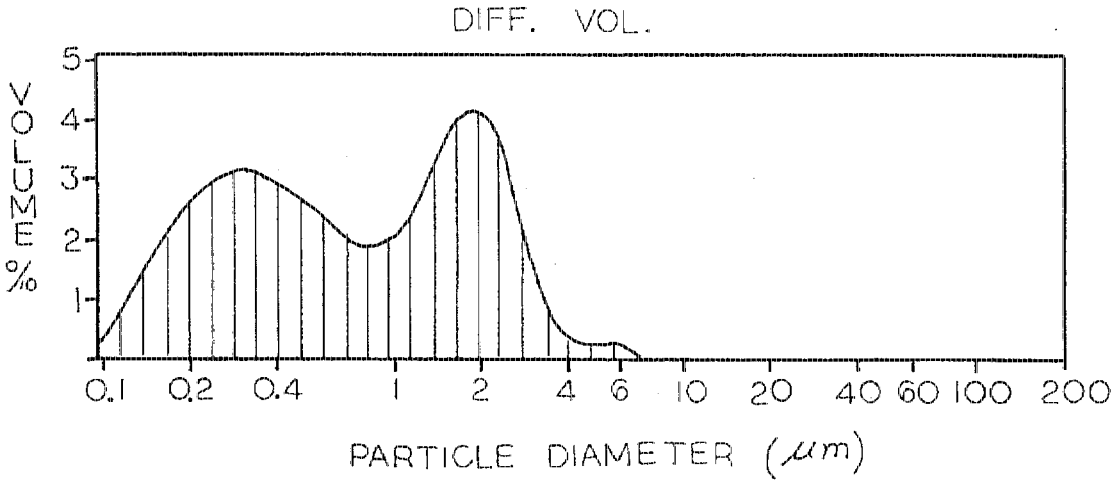
FIG. 3 is a graph illustrating the size distribution of the iron oxide powder of FIG. 2, volume percentage versus particle diameter, after it has passed through the first milling system shown in FIG. 1.

In use, the feed supply of iron oxide powder 10 is fed into the first milling system 11 wherein it is milled to particles having a diameter size ranging between 0.5 and 20 microns and a preferred mean size of approximately 1 to 2 microns, as shown in FIG. 3. As used herein, the term diameter is meant to represent the diameter of an equivalent sphere as determined by common micron size particle measuring equipment such as an Aerosizer, Coulter-Counter made by Leeds & Northrope, Inc., Micro-Trac or Horiba. Once milled the iron oxide powder often agglomerates during subsequent shipment, storage and transport. The iron oxide powder is conveyed to the screening system 12 wherein it is deposited upon the solid portion 21 of the vibrating bed 20. The vibration of the bed and its orientation causes the iron oxide powder to move towards the mesh portion 22. As the powder is conveyed along the solid portion it de-agglomerates somewhat to form loosely bound pellets and powder, hereinafter referred to collectively as powder, which is then screened through the mesh portion 22. Preferably, the mesh portion has interstices of less than 1/10 inch. also known as 8 mesh U.S. Standard. It should be understood that the sizing of the mesh is dependent upon the degree of milling accomplished in the jet mill and the size of the finished iron powder product desired, i.e. the larger the interstices the larger the particle size of the finished iron powder. It has been found that a solid portion length of approximately 1 foot, a screen portion length of 6 inches and a vibration speed of 100 c.p.m. sufficiently de-agglomerates the iron oxide powder which is sized for further processing in the production of a finished iron powder having a size and size distribution suitable to use in metal injection molding applications, i.e. having a median size diameter of less than or equal to 20 microns.

The iron oxide powder sifted through mesh portion 22 drops onto the stainless steel conveyor belt 14 positioned approximately 2 inches there below. The conveyor belt speed is approximately 3 inches per minute. With this belt speed and drop height the iron oxide powder is deposited upon the conveyor belt with a bed depth of between 0.5 and 2.0 inches, with an optimal bed depth of between 0.5 and 1.0 inch. This height difference between the mesh portion and underlying belt prevents the powder from being tamped together as it drops upon the conveyor belt. This is desired as the tamping of the iron oxide powder may prevent gases from penetrating the entire bed of iron oxide powder and cause agglomeration to particle sizes unacceptably large during subsequent steps of the process.

The de-agglomerated iron oxide powder is then conveyed into the furnace 13 where it travels the entire length of the furnace. Preferably, the furnace first preheating zone 25 is maintained at approximately 1200° F., the second preheating zone 26 is maintained at approximately 1400° F., the first and second hot zones 27 and 28 are maintained at approximately 1500° F., and the cooling zone 29 is cooled to ambient temperature by a sealed water jacket therein. A reducing agent, preferably hydrogen gas, is injected into the second hot zone, while an inert gas, preferably nitrogen, is injected into the cooling zone. It has been found that the preferred flow rate of hydrogen into the furnace is approximately 900 cubic feet per hour. It has also been found that the preferred flow rate of nitrogen into the furnace is approximately 100 cubic feet per hour. As the bed of iron oxide powder travel through the preheating zones and the hot zones the heated iron oxide reacts with the hydrogen to form substantially pure iron powder and water vapor. The water vapor and any excess gases within these zones are expelled from the furnace through an outlet 31 adjacent the furnace entrance. As the iron powder enters the cooling zone it is subjected to the nitrogen atmosphere while being simultaneously cooled. The nitrogen atmosphere prevents the cooling hot iron powder from immediately reoxidizing to iron oxide powder. The iron powder is cooled so as to emerge from the furnace at a temperature below 150° F., and preferably at a temperature close to ambient temperature to prevent the iron powder from quickly reoxidizing once exposed to ambient air. It should be understood that the cooling zone pressure in greater than that of the hot zones and ambient. This prevents air from entering the furnace and possibly causing an explosion upon reaction with the heated hydrogen and also prevents reoxidation of the iron powder before it is sufficiently cooled. The nitrogen may also be expelled from the furnace through another outlet 32 adjacent the furnace exit.

Figure 4:
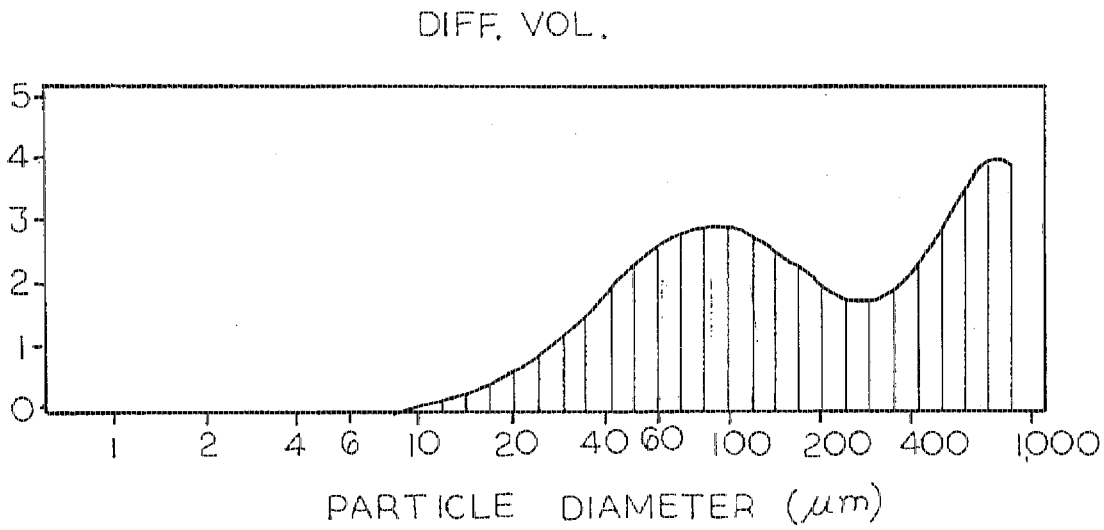
FIG. 4 is a graph illustrating the size distribution of the reduced iron powder as a result of the iron oxide powder of FIG. 3, volume percentage versus particle diameter, passing through the furnace shown in FIG. 1.
Figure 5:
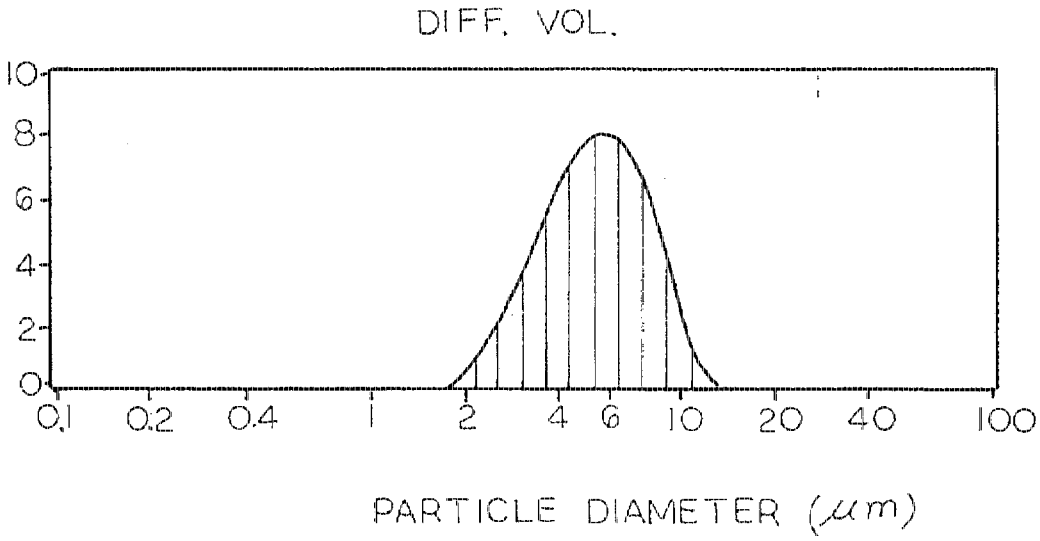
FIG. 5 is a graph illustrating the size distribution of the iron powder of FIG. 4, volume percentage versus particle diameter, after it has passed through the second milling system shown in FIG. 1.

The iron powder emerging from the furnace typically has a mean size diameter of approximately 275 microns, as shown in FIG. 4. The iron powder is then conveyed to the second milling system 15 where it is milled in an inert gas atmosphere to an iron powder having a mean size diameter of between 5.0 to 5.5 microns, as shown in FIG. 5. If desired, the resultant iron powder may be milled again so as to achieve a mean size diameter of approximately 4.3 microns. The iron powder is milled in an inert gas to prevent it from reoxidizing as it is heated by the milling process. The iron powder is then packaged in hermetically sealed containers for storage and shipment.

Figure 6:
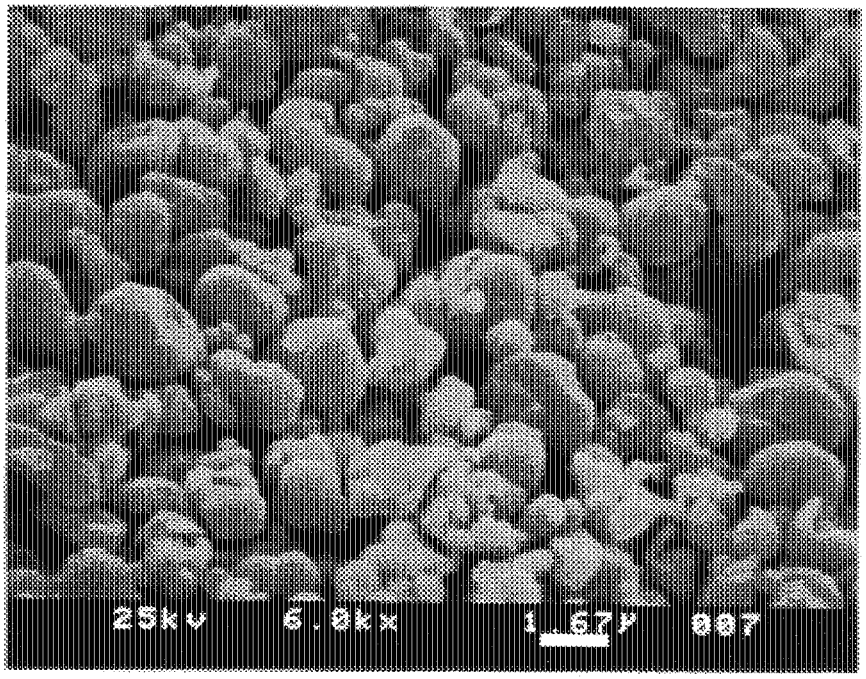
FIG. 6 is a micro-photograph of iron powder produced according to the method of the present invention.

The finished iron powder product has been found to have the desired rounded shape and compact character needed for powder injection molding, as shown in the photograph representation of FIG. 6. The iron powder particles size distribution width is also quite narrow, thus providing the benefit of consistently holding sintering dimensions of the final metal injection molding product due to its minimization of separation in molding. When compared with carbonyl iron it has been found that this shape and distribution width enables metal injection molding products to be sintered at a lower temperature to attain equivalent final dimensions. For example, in sintering a metal injection molding product using the iron powder of the instant method for 1 hour at 1200° C. it was found that the sintered density was higher and the tensile strength and ductility were higher than products made of carbonyl iron, as described in more detail hereafter. Thus one may sinter products at a lower, more efficient temperature and shorter time period, or be able to use present temperature and time parameters and obtain higher final mechanical properties.

With reference next to FIG. 7 there is shown the results of a series of tests for sintering response and rheological attributes for the iron powder of the instant method of production, hereinafter referred to as the "inventive iron powder" or IIP, to determine particle size distribution, particle shape, tap density and solids loading. A scanning electron microscope microphotograph of the inventive iron powder shows a rounded shape and a relatively low tap density of approximately 35% of theoretical density of pure iron. The true density was evaluated using pycnometer which shows that the inventive iron powder particles have a 2% porosity. The particle size distribution was measured using two different method. The first method was based on laser scattering on dispersed powder in a fluid medium. The second method is based on the time of flight measurement on particles dispersed in air. Both methods yielded similar distribution width, the first method being 7.57 and the second method being 8.74.

With reference next to FIG. 8 there is shown a comparison between the characteristics of the inventive iron powder test results and ideal iron powder. This shows that the inventive iron powder is considered very close to ideal. Also, the typical characteristics of carbonyl iron powder are a distribution width of 4.8, solids loading of 62 to 65%, and a mixing torque of 80 to 100 mg. Thus, except for the solids loading which is higher for carbonyl iron powder due to its spherical shape, the inventive iron powder is comparable to carbonyl is all other respects. Furthermore, the inventive iron powder does not contain carbon, thus it is applicable to other applications such as magnetic products and anti-radar applications.

With reference next to FIG. 9 there is shown a comparison between the sintered properties of the inventive iron powder (IIP) and carbonyl iron powder (CIP) grade ISP CIPR1470. Here tensile bars were pressed and sintered at 1200° C. for 1 hour in a $H_2$ atmosphere. The inventive iron powder sintered to higher densities and showed improved properties as compared to the carbonyl iron powder.

The just described method is for the production of iron powder used in metal injection molding. Metal injection molding quality iron powder has the median particle size diameter of between 0.1 and 20 microns. It has been found that particles less than 0.1 microns do not react well with the binder used in metal injection molding, while a size greater than 20 microns results in a mixture containing too much binder, which causes sizing problems during product sintering. However, it should be understood that this process is not limited to the production of metal injection molding iron powder and that the process can be used to produce different particle sizes of iron powder. The size of the finished iron powder is dependant upon the size of the iron oxide powder entering the furnace, i.e. the larger the particles of the iron oxide powder the larger the particles of the finished iron powder. The iron oxide powder however should be of a size less than 1000 micron to assure its proper particle size upon milling. Furthermore, as an alternative the screening system may be eliminated and unagglomerated iron oxide powder may be conveyed into the furnace, again this is dependent upon the size and shape of the finished iron powder desired. Also, the finished iron powder has a median particle size diameter of less than or equal to 20 microns.

It should also be understood that the preferred temperatures are believed to produce the iron powder in an optimal manner. However, the temperatures, conveyor speed and furnace length may be varied to provide acceptable results. For example, the temperature within the furnace may be increased and the belt speed decreased to provide acceptable iron powder or visa-versa. However, it is believed that the temperature within the furnace must be at least 1000° F. to efficiently cause the iron oxide to be reduce to iron, but be less than 2100° F. to prevent the iron oxide or resulting iron from becoming sintered. For should the iron oxide powder or resulting iron powder become sintered it would preclude its subsequent milling.

Also, as an alternative to Ruthner iron oxide other types of iron oxide such as ground iron oxide ore or ground iron oxide scrap may be used. Other inert gases may be used as an alternative to nitrogen. Lastly, other types of reducing agents may be used as an alternative to hydrogen, such as carbon monoxide and carbon powder mixed with the iron oxide powder entering the furnace. It should be understood that this includes any chemical which breaks down to form hydrogen or carbon, such as ammonia and methanol.

While this invention has been described in detail with particular references to the preferred embodiment thereof, it should be understood that many modifications, additions and deletions, in addition to those expressly recited, may be made thereto without departure from the spirit and scope of the invention as set forth in the following claims.

We claim:

1. A method of producing iron powder having a generally rounded shape and a median particle size diameter of less than 20 microns with the method comprising the steps of:

(a) heating iron oxide powder of a particle size diameter of less than 1000 microns in a reducing agent atmosphere to a temperature between of 1000° F. and 2100° F. for a time sufficient to reduce the iron oxide powder to iron powder;

(b) cooling the heated iron powder in an inert gas atmosphere to a temperature below 150° F.; and (c) milling the cooled iron powder in an inert gas atmosphere to a median particle size diameter of less than or equal to 20 microns.

2. The method of claim 1 wherein the iron oxide powder is $Fe_2O_3$.

3. The method of claim 1 wherein step (c) the iron powder is milled by grinding.

4. The method of claim 3 wherein step (c) the iron powder is ground by jet mill grinding.

5. The method of claim 1 wherein step (a) the iron oxide powder is heated in a reducing agent selected from the group consisting of hydrogen, carbon monoxide and carbon.

6. The method of claim 5 wherein step (b) the iron powder is cooled in an inert gas atmosphere of nitrogen.

7. The method of claim 6 further comprising the step of milling the iron oxide powder to a median particle size diameter of less than 20 micron prior to the heating of step (a).

8. The method of claim 7 further comprising the step of screening the iron oxide powder to form a bed of iron oxide powder prior to heating the iron oxide powder.

9. The method of claim 8 further comprising the step of forming the iron oxide powder into pellets prior to screening the iron oxide powder.

10. The method of claim 9 wherein step (a) the iron oxide pellets are heated to between 1300° F. and 1700° F.

11. The method of claim 10 wherein step (c) the iron powder is milled to a median particle size diameter of less than 20 microns.

12. The method of claim 1 wherein step (b) the iron powder is cooled in an inert gas atmosphere of nitrogen.

13. The method of claim 1 wherein step (a) the iron oxide powder is heated to between 1300° F. and 1700° F.

14. The method of claim 13 wherein step (a) the iron oxide powder is heated to approximately 1500° F.

15. The method of claim 1 further comprising the step of grinding the iron oxide powder to a median particle size diameter of less than 20 microns prior to the heating of step (a).

16. The method of claim 15 further comprising the step of screening the iron oxide powder to form a bed of iron oxide of a depth less than 2 inches prior to heating the iron oxide powder.

17. The method of claim 16 wherein the iron oxide powder is sifted to a bed depth of between 0.5 inches and 1.0 inches.

18. The method of claim 1 further comprising the step of screening the iron oxide powder to form a bed of iron oxide of a depth less than 2 inches.

19. The method of claim 18 wherein the iron oxide powder is sifted to a bed depth of between 0.5 inches and 1.0 inches.

20. The method of claim 18 further comprising the step of forming the iron oxide powder into pellets prior to screening.

21. The method of claim 1 wherein the iron oxide powder is heated in step (a) by a muffle furnace.

22. The method of claim 1 wherein step (a) the iron oxide powder is incrementally heated to approximately 1200° F., to approximately 1400° F., and to approximately 1500° F.

23. The method of claim 1 further comprising the step of hermetically sealing the iron powder for storage.

24. A method of producing metal injection molding quality iron powder having a generally round particle shape and a median particle size diameter of less than 20 micron, said method comprising the steps of:

(a) providing a supply of $Fe_2O_3$ powder of a particle size diameter of less than 1000 microns;

(b) heating the supply of $Fe_2O_3$ powder in a reducing agent atmosphere to a temperature between of 1000° F. and 2100° F. for a time sufficient to reduce the $Fe_2O_3$ powder to iron powder;

(c) cooling the heated iron powder to a temperature below 150° F.; and (d) reducing the cooled iron powder to a median particle size diameter of less than 20 microns.

25. The method of claim 24 wherein step (d) the iron powder is milled by grinding.

26. The method of claim 25 wherein step (d) the iron powder is ground by jet mill grinding.

27. The method of claim 24 wherein step (b) the $Fe_2O_3$ powder is heated in a reducing agent selected from the group consisting of hydrogen, carbon monoxide and carbon.

28. The method of claim 24 wherein step (d) the iron powder is milled by jet mill grinding in an inert gas atmosphere.

29. The method of claim 24 wherein step (c) the iron powder is cooled in an inert gas atmosphere.

30. The method of claim 29 wherein step (c) the iron powder is cooled in an inert gas atmosphere of nitrogen.

31. The method of claim 29 further comprising the step of milling the $Fe_2O_3$ powder to a median particle size diameter of less than 20 microns prior to heating the $Fe_2O_3$ powder.

32. The method of claim 31 further comprising the step of screening the $Fe_2O_3$ powder to form a bed of $Fe_2O_3$ powder prior to heating the $Fe_2O_3$ powder.

33. The method of claim 32 further comprising the step of forming the $Fe_2O_3$ powder into pellets prior to screening.

34. The method of claim 33 wherein step (b) the $Fe_2O_3$ powder pellets are heated to between 1300° F. and 1700° F.

35. The method of claim 34 wherein step (d) the iron powder is milled in an inert gas atmosphere.

36. The method of claim 24 wherein step (b) the $Fe_2O_3$ powder is heated to between 1300° F. and 1700° F.

37. The method of claim 36 wherein step (b) the $Fe_2O_3$ powder is heated to approximately 1500° F.

38. The method of claim 24 further comprising the step of screening the $Fe_2O_3$ powder to form a bed of $Fe_2O_3$ of a depth less than 2 inches prior to heating the $Fe_2O_3$ powder.

39. The method of claim 38 wherein the $Fe_2O_3$ powder is sifted to a bed depth of between 0.5 inches and 1.0 inches.

40. The method of claim 38 further comprising the step of forming the $Fe_2O_3$ powder into pellets prior to screening.

41. The method of claim 24 wherein the $Fe_2O_3$ powder is heated in step (b) by a muffle furnace.

42. The method of claim 24 wherein step (b) the $Fe_2O_3$ powder is incrementally heated to approximately 1200° F., to approximately 1400° F., and to approximately 1500° F.

43. The method of claim 24 further comprising the step of hermetically sealing the iron powder for storage.

44. The method of claim 24 wherein step (d) the iron powder is milled in an inert gas atmosphere.

* * * * *